United States Patent [19]

Desanta

[11] 4,369,997

[45] Jan. 25, 1983

[54] CHAIR

[75] Inventor: Simon Desanta, Gütersloh, Fed. Rep. of Germany

[73] Assignee: Kusch & Co., Sitzmohelwerke KG, Hallenberg, Fed. Rep. of Germany

[21] Appl. No.: 209,404

[22] PCT Filed: Jan. 29, 1980

[86] PCT No.: PCT/DE80/00010

§ 371 Date: Sep. 29, 1980

§ 102(e) Date: Sep. 29, 1980

[87] PCT Pub. No.: WO80/01534

PCT Pub. Date: Aug. 7, 1980

[30] Foreign Application Priority Data

Jan. 29, 1979 [DE] Fed. Rep. of Germany ..... 2903251
Feb. 3, 1979 [DE] Fed. Rep. of Germany ..... 2904148

[51] Int. Cl.[3] ..... A47C 1/034

[52] U.S. Cl. ..... 297/68; 297/83; 297/319; 297/433

[58] Field of Search ..... 297/68, 83, 86, 433, 297/DIG. 10, 319

[56] References Cited

U.S. PATENT DOCUMENTS

| | | | |
|---|---|---|---|
| 9,128 | 7/1852 | Bass | 297/68 |
| 186,870 | 1/1877 | Patch | 297/68 |
| 2,471,024 | 5/1949 | Cramer | 297/319 |
| 2,858,876 | 0/0000 | Woodson, Jr. . | |
| 2,919,746 | 1/1960 | Fidel | 297/68 |
| 3,005,660 | 10/1961 | Winick | 297/319 X |

FOREIGN PATENT DOCUMENTS

| | | | |
|---|---|---|---|
| 936817 | 2/1957 | Fed. Rep. of Germany . | |
| 628965 | 7/1927 | France | 297/68 |
| 1037769 | 5/1953 | France | 297/68 |
| 179018 | 1/1954 | Switzerland . | |

*Primary Examiner*—Francis K. Zugel
*Attorney, Agent, or Firm*—Stevens, Davis, Miller & Mosher

[57] ABSTRACT

In a chair with elevated seat surface and footrest, a seat (30, 114), a footrest (38, 162)and a backrest (24) are connected with each other in such a manner that they are swingable jointly from a position suitable for sitting with seat substantially horizontal into a position with strongly forward inclined seat in which the chair can be used as standing rest. The joint swinging is effected by means of a yoke (22; 88, 94; 130, 132, 136, 138) which extends from the footrest to the backrest and consists of a single piece or else can be divided into at least two yoke sections. The seat, the footrest and/or the backrest can be adjustable by separate adjustment devices (46, 50, 60) with respect to the yoke, and in the event of the use of a plurality of divided yoke sections, adjustment devices (98, 140) can be provided in the connection regions of the sections.

15 Claims, 11 Drawing Figures

CHAIR

This invention relates to a chair with elevated seat surface, having a seat mounted on a vertically adjustable column and a backrest, which seat and backrest are displaceable around horizontal transverse axes, and having a displaceable footrest.

Such chairs can be used in particular as work chairs at high work places. Generally they have an ordinary adjustment mechanism which permits a limited swinging motion of seat and/or backrest around horizontal transverse axes. For example, the seat is adjustable at most between a substantially horizontal position and a slightly rearward inclined position.

In addition to this a chair is known from U.S. Pat. No. 2,858,876 in which the footrest is fastened directly. to the seat and can be swung with the latter. The chair of this U.S. patent permits its use as so-called standing support or standing aid, against which a person can rest upon work which is carried out in a standing position.

The object of the invention is to develop a chair of the aforementioned type in such a manner that the seat, the footrest and the backrest are swingable synchronously with each other in an ergonomically favorable manner between different positions suitable for sitting and a standing-support position.

This object is achieved in accordance with the invention in a chair of the aforementioned type by a yoke which is swingable around a horizontal transverse axis and to the upper end of which the backrest is swingably connected while its lower end is developed as footrest.

The seat is preferably also connected with the middle region of the yoke. Such a chair permits simultaneous displacement of seat, backrest and footrest by means of a single manipulation.

The seat, the backrest and/or the footrest can be connected with the yoke via adjustment devices which permit an additional, separate adjustment movement of these parts. Such separate adjustment movements can also be made possible in the manner that the yoke is developed in two or more parts and is provided in the regions of connection of the individual sections with adjustment devices which permit mutual displacement of the sections of the yoke.

For ergonomic reasons it may be advantageous to impart the seat a smaller swinging motion than the backrest and footrest upon conversion of the chair from a sitting position into the standing-support position. For this purpose, the seat can, for instance, be swingably supported in its front region in a horizontal transverse axis on a forward extending extension arm of the column and be connected with the yoke in the rearward region in a horizontal link which permits parallel displacement with respect to the seat and/or the yoke so that the seat does not participate in the full swinging motion of the yoke upon the swinging of the latter.

The aforementioned link on the rear bottom side of the seat, which link is displaceable with respect to the seat and/or the yoke can preferably be formed by a hydraulic cylinder, force accumulator, detent mechanism or the like which is arranged below the seat and the extendable piston rod of which points rearward and is connected at its free end with a link which is arranged fixed on the yoke. By such an adjustment mechanism the movements of seat, foot-rest and yoke can be locked and unlocked by a single manipulation. This solution can also be used for ordinary chair mechanisms and therefore with chairs without footrest. It offers the advantage that the locking mechanism or force accumulator can be arranged flat below the seat and thus does not interfere with the covering of the seat from below, and it furthermore permits, as will be explained in further detail, complete relief of the locking mechanism from bending forces.

The yoke can, for instance, extend upwards from the footrest and then along below the seat and upwards along the rear of the seat to the backrest, but it may also have some other shape. Several embodiments of the invention will be explained in further detail below with reference to the accompanying drawing in which FIGS. 1 to 3 show diagrammatic side views of various embodiments of the chair;

Figure 1:
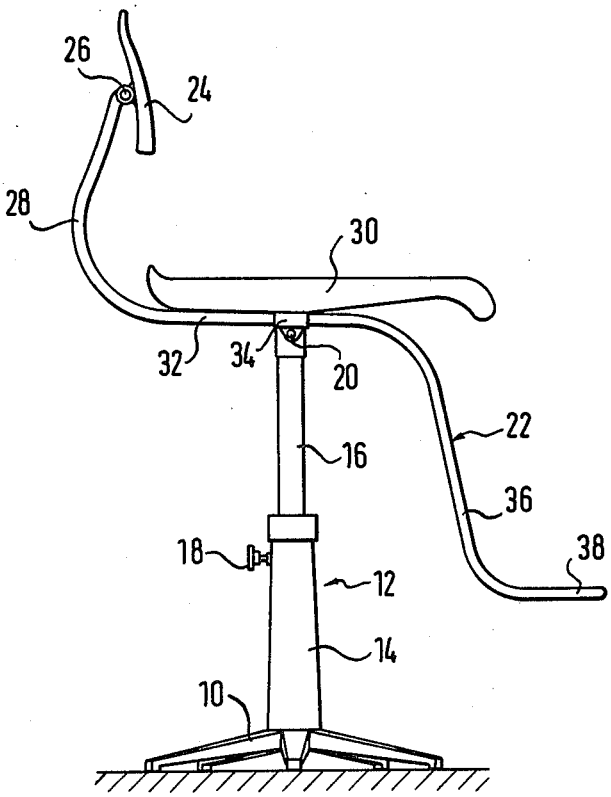

A chair in accordance with FIG. 1 comprises first of all a five-arm foot 10 and a vertical column 12 extending from the foot, the column consisting of an outer pipe 14 which proceeds from the foot 10 and an inner pipe 16 which is telescopically displaceable in said outer pipe, as well as of a height adjustment 18 which has been shown merely diagrammatically and which, in customary manner, may contain a gas spring in combination with a release and locking mechanism or the like. At the upper end of the column 12 there is a horizontal transverse shaft 20 in which there is swingably supported a yoke, designated generally as 22. The yoke 22 commences in the region of a backrest 24, to the rear of which the upper end of the yoke is swingably connected via a horizontal link 26. The yoke then extends in arcuate form in a section 28 below the rear of a seat 30 and then in another substantially horizontal section 32 below the seat 30 to which the section 32 is firmly connected. The section 32 of the yoke furthermore bears in its central region a fitting 34 (not shown in detail) which receives the horizontal transverse shaft 20.

Below the front region of the seat 30 the yoke 22 extends downward in another section 36 to a horizontally extending section 38 which forms a footrest. The yoke 22 is, for instance, developed as a single bar in its rear section 28 and in a double layer in the front sections 36 and 38 and at the free end of the section 28 it is closed by a transverse bar (not shown) which forms the actual footrest.

The yoke 22 and, with it, the backrest 24, the seat 30 and the section 38 forming the footrest are swingable as a whole around the horizontal transverse shaft 20 between two end positions which correspond to the positions shown in FIGS. 4 and 6 of the embodiment described below. While the slightly backward inclined position of FIG. 4 serves for relaxed sitting, the seat is inclined strongly forward, in the position shown in FIG. 6 the backrest is pushed forward and the footrest pushed back against the column so that the chair can be used as standing support or standing aid. The yoke 22 can be locked with respect to the column, in a manner not shown in the drawing, in any desired angular position of its range of swing.

Figure 2:
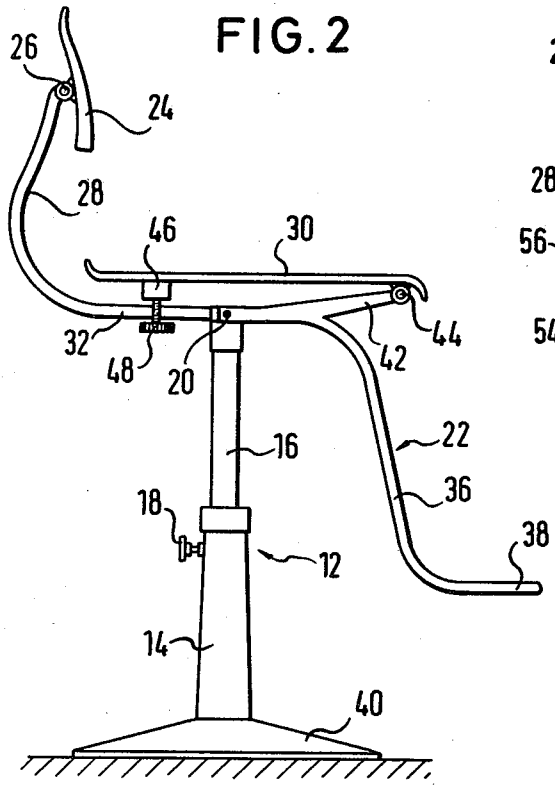

The embodiment shown in FIG. 2 corresponds in its essential parts to the embodiment of FIG. 1 so that the same reference numbers have been used for corresponding parts. Instead of the five-arm foot 10 of FIG. 1 a circular footplate 40 is provided in the embodiment of FIG. 2. In the embodiment of FIG. 2, the backrest 24, the seat 30 and the footrest section 38 are swingable in synchronism with each other and with the yoke 22 around the horizontal transverse shaft 20 in the same manner as in the embodiment of FIG. 1. In addition, the embodiment of FIG. 2, however, permits a relative swinging of the seat 30 with respect to the yoke 22 and thus the backrest and footrest. For this purpose, the yoke 22 is provided in the front region of the seat 30 with a forward directed extension 42, on the free end of which the seat 30 is swingably supported, via a fitting not shown about detail, in a horizontal transverse shaft 44. Furthermore, below the rear region of the seat 30 there is a diagrammatically indicated adjustment device 46 having a hand wheel 48 which is located below the yoke and provided with a screw, said hand wheel permitting a change in the distance between the seat 30 and the yoke 22 and thus a change in the inclination of the seat with respect to the yoke.

Figure 3:
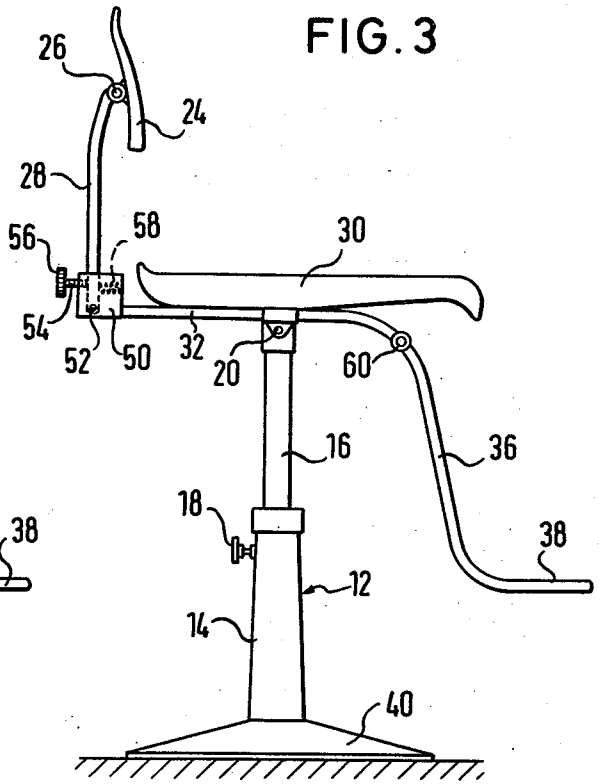

FIG. 3 shows a corresponding separate displacement for the backrest 24 but otherwise agrees essentially with the embodiments of FIGS. 1 and 2, the reference numbers of which have again been in part used. In the embodiment of FIG. 3 the seat 30 is also arranged fixed on the central yoke section 32 and is swingable with the yoke around the horizontal transverse shaft. In contradistinction to FIG. 1, however, the rear yoke section, and thus the backrest 24, is adjustable separately forwards and backwards with respect to the central yoke section 32. On the rear end of the central yoke section 32 there is a box-shaped adjustment device 50 which is open on top and into which the yoke section 28 which is separate from the section 32 enters from above. The rear section 28 of the yoke is swingable forward and backward around a transverse shaft 52 which has been merely indicated. A screw 54 enters from the rear through the wall of the adjustment device 50 and is in threaded engagement with it. On the free end of the screw 54 there is a hand wheel 56 for turning the screw. The yoke section 28 and thus the backrest can be swung forward by the screw. A compression spring 58 or the like (which has been diagrammatically indicated) brings the yoke section 28 back.

Finally, there may also be provided an adjustment device 60, which has been merely indicated in the drawing, which permits of separate adjustment of the footrest section 36, 38 with respect to seat and backrest.

While in principle the seat, backrest and footrest are swingable synchronously with each other around the horizontal transverse shaft 20 from a sitting position into a standing-support position, the separate adjustment devices 46, 50, 60 described with reference to FIGS. 2 and 3 serve primarily to create a position of the chair which particularly satisfies the requirements of a given user. The three adjustment devices may be used in any desired combination.

Figure 5:
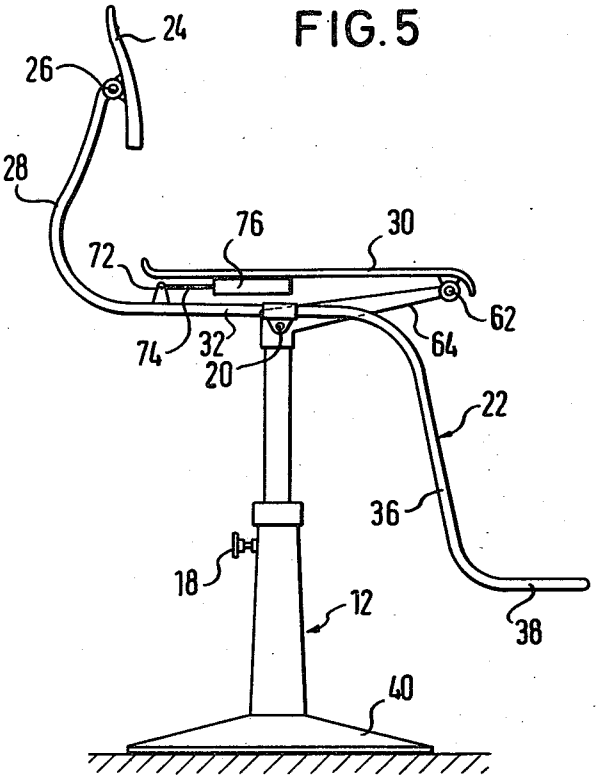
FIGS. 4 to 6 show another embodiment of the chair in three different positions.
Figure 4:
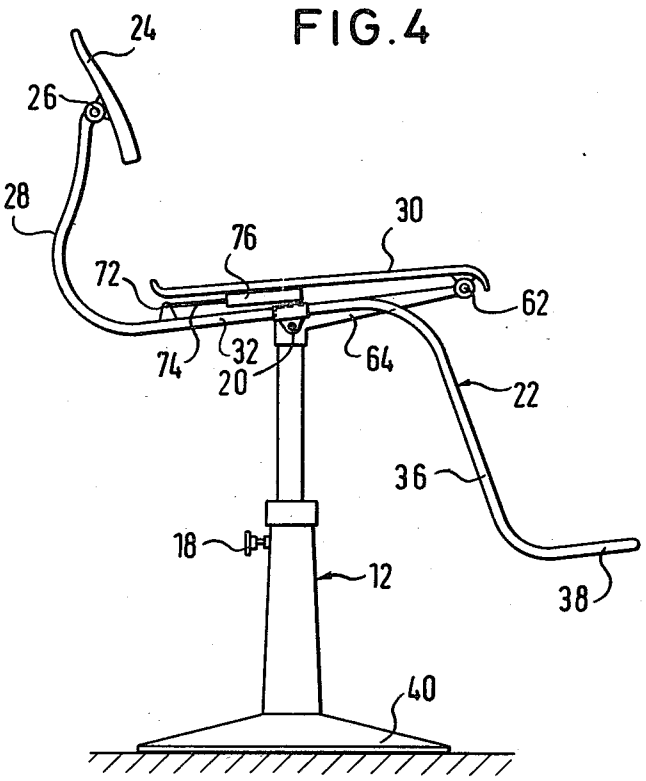
Figure 6:
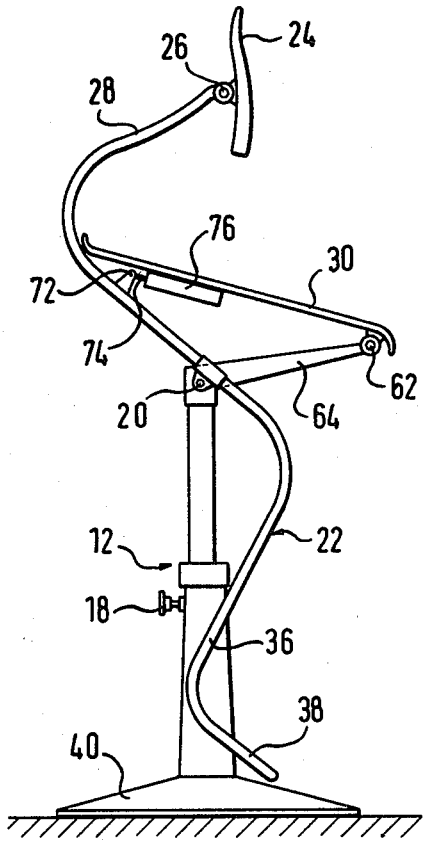

The embodiment in accordance with FIGS. 4 to 6 is based on the embodiments of FIGS. 1 to 3 so that FIGS. 4 to 6 bear, in part, the same reference numbers.

In the horizontal transverse shaft 20 at the upper end of the column 12 there is again swingably supported the yoke 22. Differing from FIGS. 1 to 3, the seat 30 is swingably supported below its front region in a transverse shaft 62 at the front end of a extension arm 64 which extends obliquely forward and upward from the upper end of the column 12.

Below the rear edge of the seat 30 there is a link 72 which connects the yoke 22 with the seat 30 but is displaceably connected with at least one of these parts. In the embodiment shown, the link 72 is arranged rigidly on the yoke 22 while it is connected with the seat 30 by means of a piston rod 74 of a lockable hydraulic cylinder 76 which is fastened to the bottom of the seat 30.

FIGS. 4 to 6 show the work chair in different positions. In accordance with FIG. 4, the work chair is in a position for relaxed sitting in which the seat 30 is inclined slightly rearward. For transition into the position shown in FIG. 5 which serves for sitting in a straight upward position, the user of the chair need merely, without leaving the chair, loosen a lock (not shown) of the hydraulic cylinder 76 and exert a slight pressure with his feet on the footrest. In that way the footrest is lowered, the seat 30 is lifted at the rear and the backrest 24 is pushed forward. The work chair can then again be locked. Upon the swinging movement of the yoke 22 from the position of FIG. 4 into the position of FIG. 5, the piston rod 74 is pushed slightly into the hydraulic cylinder 76.

Upon further swinging of the yoke 22 in clockwise direction as shown in FIGS. 4 and 5, there is obtained the position shown in FIG. 6 in which the work chair is suitable for use as standing support. In this position, the lower sections 36 and 38 of the yoke 22 which bear the footrest are pushed back against the column 12 so that they permit free standing in front of the chair. The seat 30 is inclined towards the front at an angle of, for instance, 25° to the horizontal. The backrest 24 is pushed far forward.

The locking by the hydraulic cylinder 76 comprises the entire yoke 22 and thus the footrest, the seat and the backrest. The hydraulic cylinder 76 at the same time has a certain dampening action. Instead of the hydraulic cylinder, any other locking mechanism can be used, as will be explained in detail further below.

Figure 7:
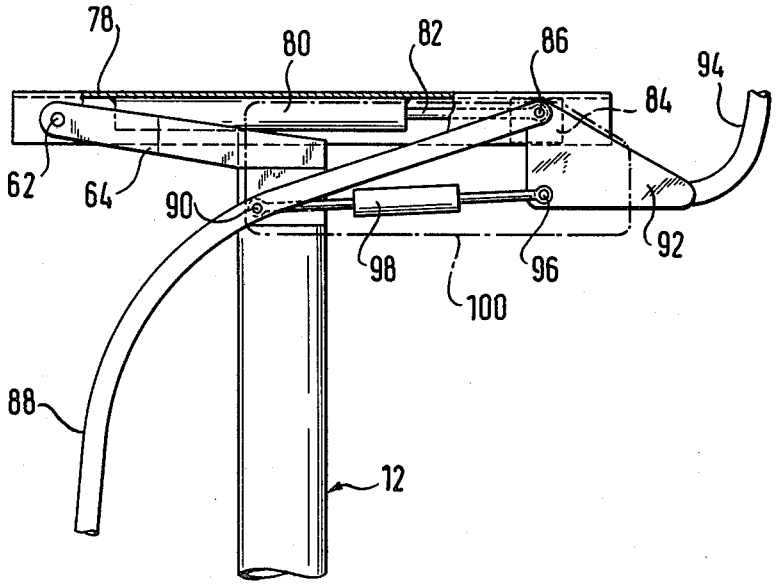
FIG. 7 is a partial diagrammatic side view of another embodiment of the chair.

FIG. 7 is a partial view of an embodiment which is developed on basis of the embodiments in accordance with FIGS. 4 to 6 but has a divided yoke rather than a coherent yoke. Those parts of FIG. 7 which correspond with corresponding parts of the embodiment described above bear the same reference numbers. At the upper end of the column 12 there is again an obliquely upward and forward directed extension arm 64 on the free end of which the horizontal transverse shaft 62 is provided. The extension arm 64 is developed in fork shape in a manner not shown in the drawing and supports the transverse shaft 62 on both ends. The transverse shaft passes through a rail 78 of U-shaped cross section which is open at the bottom and to the bottom of which there is fastened a hydraulic cylinder 80 whose rearward directed piston rod 82 is connected with a slide piece 84 which travels in the rail, which, however, can be omitted, if the piston rod 82 is suitably dimensioned. The hydraulic cylinder 80 corresponds to the hydraulic cylinder 76 of FIGS. 4 to 6. At the end of the piston rod 82 or in the slide piece 84 there is a horizontal transversely directed link 86, which will be described in further detail below.

In FIG. 7 there is shown in particular a yoke section 88 which corresponds to the section of the yoke 22 in FIGS. 4 to 6 between the link 72 and the region of the footrest. The region of the footrest is, however, omitted in FIG. 7. The yoke section 88 is swingably supported in a horizontal transverse shaft 90 at the upper end of the column 12, which shaft corresponds to the transverse shaft 20 of FIGS. 4 to 6. In its further course, the yoke section 88 is swingably supported in the link 86. When the yoke section 88 is swung around the horizontal transverse shaft 90, for instance by stepping on a support not shown in the drawing, the slide piece 84 slides to the left in FIG. 7 within the rail 78 and the piston rod 82 is pushed into the hydraulic cylinder 80. This movement leads to the raising of the right-hand end of the rail. The rail represents the support for a seat (not shown) so that the rear region of the seat is lifted.

In the horizontal link 86 there is swingably supported at the same time a substantially triangular intermediate piece 92 with which there is rigidly connected another yoke section 94 which forms the continuation of the yoke section 88 and bears the backrest, in a manner not shown. In another transversely directed link 96 located below the link 86 the intermediate piece 92 is pivotally connected with a force accumulator 98, for instance a gas spring whose other end is supported swingably in the horizontal transverse shaft 90 on the column 14. Insofar as this force accumulator 98 remains permanently blocked, there is no difference in function from the embodiment of FIGS. 4 to 6. The yoke section 94 which bears the backrest is swung synchronously with the yoke section 88 around the horizontal transverse shaft 90. This synchronously adjustability can, however, be changed by the extension or retraction of the force accumulator 98 so that the backrest can be moved, for instance, further forward without the footrest being stepped upon and the seat being swung up at its rear end.

It is obvious that the force accumulator 98 of the type shown is merely one example. Another example of the possibility of adjustment of the position of the backrest will be described later.

The yoke section 88 need not be developed in bar shape in the region below the seat, as is diagrammatically shown in FIG. 7. It can be replaced, for instance, by lateral shell parts 100 shown in dash-dot line connected rigidly with the region of the footrest, said parts being swingably supported in the transverse shaft 90 and the link 86 and at the same time covering the force accumulator 98 on the sides and from the bottom. Another solution will be taken up in detail further below.

Figure 8:
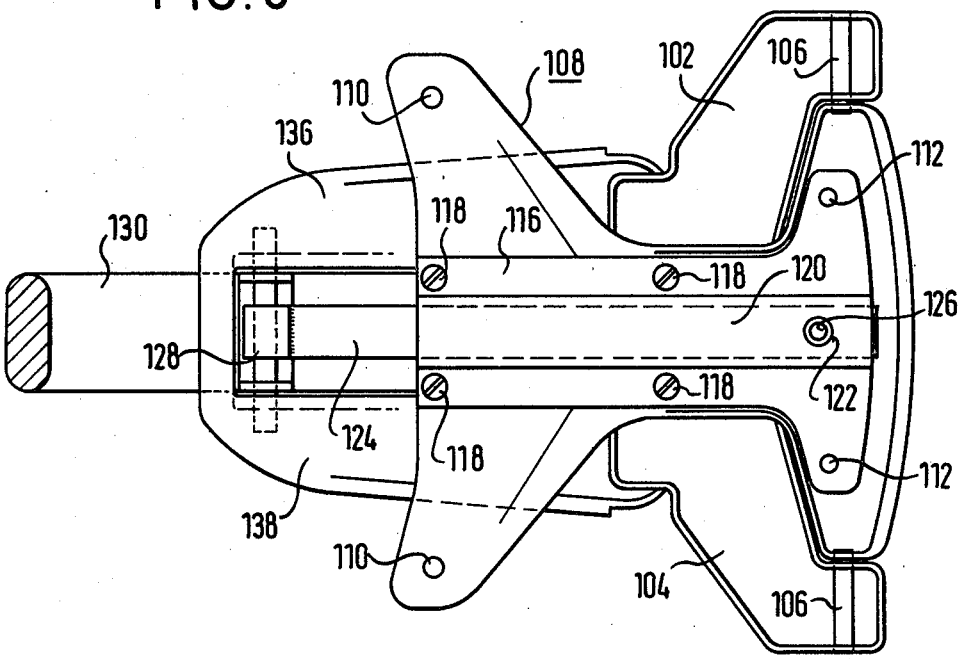
FIG. 8 is a partial top view of another chair with the seat omitted.
Figure 10:
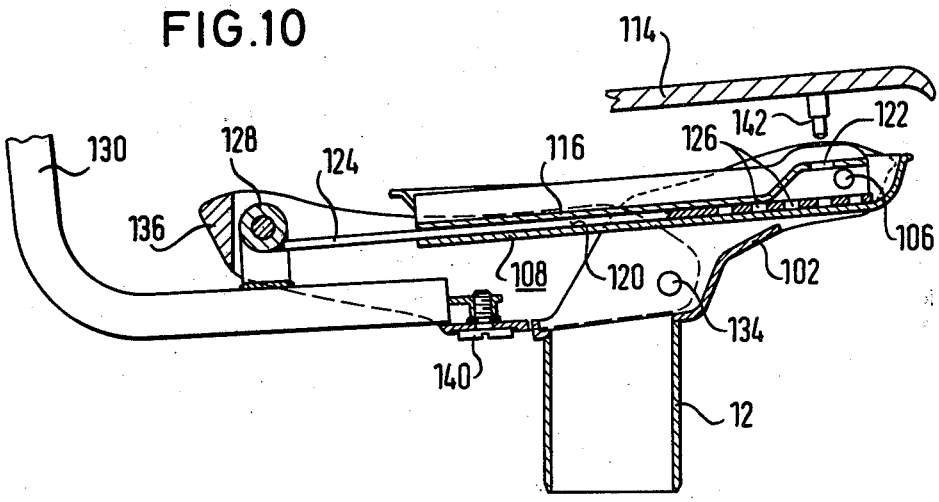
FIG. 10 is a vertical section through FIG. 8.
Figure 9:
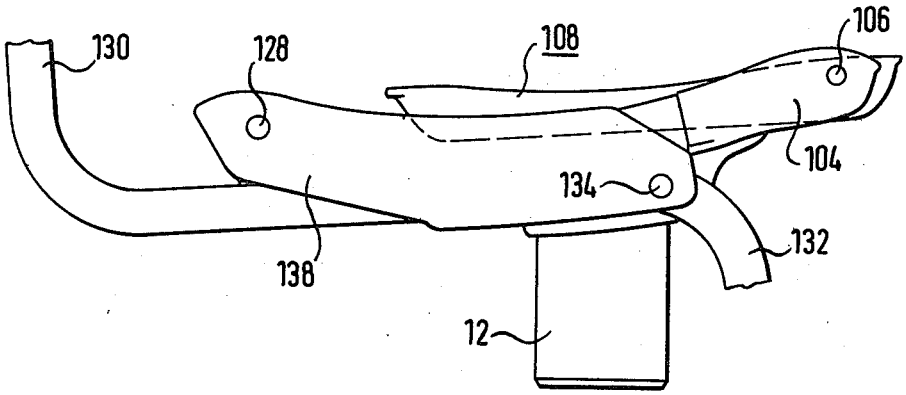
FIG. 9 is a side view of FIG. 8.

The embodiment shown in FIGS. 8 to 10 corresponds essentially to the embodiment of FIG. 7 but will be explained further with respect to a few existing differences. An extension arm which is as a whole of fork shape and is arranged at the upper end of the column 12 comprises two arms 102, 104 which receive a horizontal transverse shaft 106 which swingably support (sic)a seat support 18. The extension arm and the support are developed as shell-shaped parts, for instance of sheet metal or the like, in contradistinction to the schematically indicated embodiment of FIG. 7. Boreholes 110, 112 serve to receive a seat 114, which has been merely partially indicated in FIG. 10. In the support 108 an insert 116 is inserted by means of the screws 118 indicated, which form on the bottom of the support a guide 120 which extends rearward from the front. In the front central region, the insert 116 has a borehole 122, which will be discussed in further detail below. The guide 120 serves to receive a longitudinally displaceable detent tongue 124 which has a plurality of successive boreholes 126. The detent tongue 124 is fastened at its rear end to a link 128 which is arranged on a rear yoke section 130 which bears the backrest in a manner not shown in detail. The link 128 corresponds to the link 72 and the detent tongue 126 corresponds to the hydraulic cylinder 74 of FIGS. 4 to 6.

The front yoke section 130 (FIG. 9) which has been merely indicated and extends from the region of the footrest (not shown) continues over a horizontal transverse shaft 134 at the upper end of the column 12 into lateral shell parts 136, 138 with which the yoke section 132 is welded, for instance, from the inside. Said shell parts have already been indicated in FIG. 7. The shell parts 136, 138 are furthermore connected swingably at their rear ends to the link 128. The rear yoke section is, however, in accordance with FIG. 10 not rigidly connected with the shell parts 136, 138 but rather via a set screw 140 which permits a certain relative adjustment between the rear yoke section 130 and the shell parts 136, 138 and thus the front yoke section 132. Instead of the set screw the force accumulator 98 is provided in FIG. 7. The set screw 140, which has been merely diagrammatically indicated, can be replaced by other adjustment possibilities. If they are not actuated there is once again obtained the basic function of the simultaneous swinging of the footrest, seat and backrest.

In order to lock the detent tongue 124 a pin 142 is indicated in the drawing which is located on the bottom of the upwardly swingable or removable seat 114 and can be introduced through the borehole 122 into one of the boreholes 126 of the detent tongues 124. If the user is seated on the seat 114, this detent connection is reliably maintained by the weight of his body. Furthermore, this manner of detent locking may be desirable in that it is displaceable in positive manner only after getting off from the seat, as may be necessary, for instance, for reasons of safety. In general, adjustment of the work chair of the invention is possible, however, without getting off from the seat by simple displacement of the weight of the body.

The invention thus refers to a chair, particularly a work chair, which by interconnected swinging over of the footrest and of the seat and possibly of the backrest can be converted from a chair suitable for elevated sitting into a standing support. The interconnection of the movement of footrest, seat and/or backrest is effected by means of a yoke which, however, need not constitute a continuous unit but may also be composed of individual sections, within the connection region of which mechanical, hydraulic, pneumatic etc. adjustment and transmission devices can be located. One particular advantage of the arranging of the parts controlling all adjustment functions of the chair with the exception of the height adjustment, namely hydraulic cylinders, detent tongues, force accumulator, etc., below the chair as is shown in FIGS. 4 to 10 is first of all that this does not prevent a covering of the seat from below as in the case with gas springs or the like arranged free between the column and the seat or backrest. The displacement device can possibly, as shown in FIG. 7, however, also be completely relieved of bending forces and thus be reduced in its dimensions. This type of adjustment device below the seat is applicable also to ordinary chairs without footrest.

Figure 11:
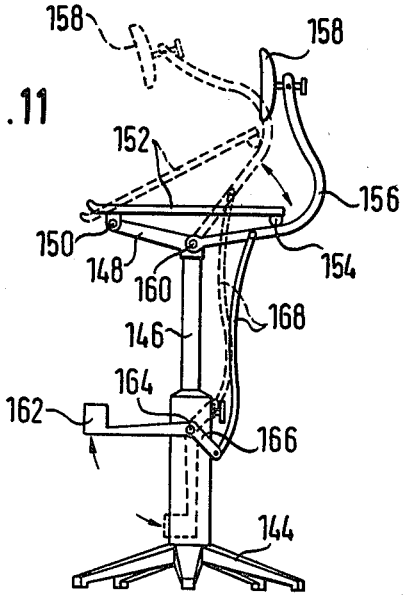
FIG. 11 shows a further variant of the chair.

While in the embodiments previously described the yoke extends upward from the footrest and then below the seat to the rear thereof and from there upwards to the backrest, FIG. 11 shows an embodiment in which the shape of the yoke has been considerably modified.

On a five-arm foot 144 there is a vertically adjustable column 146 from the upper end of which an extension arm 148 extends obliquely upward and forward. At the front end of the extension arm 148 there is a horizontal transverse shaft 150 in which the front region of the seat 152 is swingably supported. The rear region of the seat rests via a slide piece 154 on a yoke section 156 which bears the backrest 158. The rear yoke section 156 is swingable in a horizontal transverse shaft 160 at the upper end of the column 146.

A footrest 162 is swingably arranged on the column 146 in a horizontal transverse shaft 164 and extends rearward by an arm 166 beyond the swivel shaft 164. To the free end of the arm 166 there is pivotally connected a lift rod 168 whose other end is pivotally connected with the yoke section 156.

As soon as a lock (not shown) is released, the footrest 162 can be pushed down into the position shown in broken line. In this connection the arm 166 and thus the lift rod 168 rise so that the rear yoke section 156 is swung forward into the position shown in broken line carrying the seat 152 along with it. The yoke thus consists, in this case, of the footrest 162 with the arm 166, the lift rod 168 and the rear yoke section 156.

I claim:

1. An adjustable chair with an elevated seat having a backrest, seat and footrest which are adjustable from a first position in which the seat is generally horizontal, the backrest is to the rear of at least a major portion of the seat and the footrest extends forward of the front edge of the seat to a second position in which the backrest is forward of said first position, the seat is tilted forward and the footrest is to the rear of the forward edge of the seat, said chair comprising:

(a) an upstanding support pedestal having a generally horizontal pivot shaft at its upper end;

(b) a generally S-shaped yoke having its central portion pivotally secured to said pivot shaft with an upper portion pivotally supporting said backrest for movement about a substantially horizontal pivot point and a lower portion extending downwardly and forwardly to form said footrest;

(c) said seat being secured to at least one of said central portion of said yoke and said pedestal so that upon movement of the yoke to pivot the footrest backward and the backrest forward, said seat will tilt forward so as to partially support a person in the standing position in front of the chair.

2. The chair of claim 1 in which the central portion of the yoke is connected with the seat.

3. The chair of claim 1 in which the seat is separately adjustable through a limited range with respect to the footrest and the backrest.

4. The chair of claim 1 in which the yoke extends in an arcuate shape from the footrest to the backrest with the seat being mounted pivotally with respect to the yoke and an adjustment device between the yoke and the seat to vary the seat angle in relation to the yoke.

5. The chair of claim 1 in which the seat is pivotally mounted with respect to the yoke and the pedestal by means of separate generally horizontal shafts with at least one of said shafts permitting relative displacement of the seat in the front to back direction.

6. The chair of claim 5 in which the front portion of the seat is pivotally supported on an arm extending forwardly from the pedestal and rear portion of the seat is connected with the yoke by a horizontal link which permits displacement of the seat parallel to the yoke.

7. The chair of claim 6 in which the horizontal link is an axial adjustment device having one end connected to the yoke and the other end connected to the seat.

8. The chair of claim 7 in which the axial adjustment device is a fluid piston and cylinder.

9. The chair of claim 7 in which the axial adjustment device is an elongated detent tongue displaceable in a support which receives the seat and positioned so that the seat can be lifted and a downwardly pointing pin is engageable in successive openings in the detent tongue.

10. The chair of claim 1 in which the yoke comprises at least two separate sections connected together.

11. The chair of claim 10 in which the yoke sections are connected together with means to vary the angular relationship between the separate sections.

12. The chair of claim 1 having the yoke divided into two portions, the first portion extending from the footrest upwardly past the seat to a point approximately below the backrest and the second section extending at an angle to the first section and up to the backrest.

13. The chair of claim 12 including means between said first and second section for adjusting the angle therebetween.

14. The chair of claim 12 in which the first portion of the yoke is in the form of two lateral shell parts which laterally cover the seat.

15. The chair of claim 13 in which the adjusting means includes a gas pressure spring between the yoke sections.

* * * * *